US008359957B1

(12) United States Patent
Riha

(10) Patent No.: US 8,359,957 B1
(45) Date of Patent: Jan. 29, 2013

(54) METHOD OF INCREASING CHAIN SAW SPEED WHILE REGULATING FEED

(75) Inventor: Gary D. Riha, Green Bay, WI (US)

(73) Assignee: Barko Specialty Equipment, LLC, Superior, WI (US)

( * ) Notice: Subject to any disclaimer, the term of this patent is extended or adjusted under 35 U.S.C. 154(b) by 785 days.

(21) Appl. No.: 12/423,081

(22) Filed: Apr. 14, 2009

(51) Int. Cl.
*B27B 17/02* (2006.01)

(52) U.S. Cl. ..... 83/13; 30/381

(58) Field of Classification Search ..... 30/381–387; 144/34.1, 336, 4.1
See application file for complete search history.

(56) References Cited

U.S. PATENT DOCUMENTS 2,795,933 A * 6/1957 McCallum ..... 173/8
3,593,804 A 7/1971 Snider
4,010,544 A * 3/1977 Siman ..... 30/381
4,722,258 A * 2/1988 Johnson ..... 83/72
5,103,881 A 4/1992 Johnson
2003/0097917 A1 * 5/2003 Virvalo et al. ..... 83/74

* cited by examiner

*Primary Examiner* — Stephen Choi
(74) *Attorney, Agent, or Firm* — Brinks Hofer Gilson & Lione

(57) ABSTRACT

A method of increasing chain saw speed while regulating feed includes a speed increaser and a hydraulic flow bleeding device. The speed increaser preferably includes a mounting plate, a drive sprocket, a driven sprocket and a drive belt. The drive sprocket is rotated with a hydraulic motor. The driven sprocket is attached to a drive shaft and driven by the drive belt. The drive shaft is inserted into a chain saw assembly, which is attached to the mounting plate. An input of the hydraulic motor is connected to an output of a hydraulic pump. An output of the hydraulic motor is connected to an input of a hydraulic cylinder and a hydraulic flow bleeding device. The speed of the chain saw may decrease as thereof cuts through a piece of wood. As the speed of the chain saw decreases, a feed rate of the hydraulic cylinder will also decrease.

20 Claims, 6 Drawing Sheets

METHOD OF INCREASING CHAIN SAW SPEED WHILE REGULATING FEED

BACKGROUND OF THE INVENTION

1. Field of the Invention

The present invention relates generally to chain saws and more specifically to a method of increasing chain saw speed while regulating feed, which increases the speed of a chain saw for utilizing a lower horsepower motor.

2. Discussion of the Prior Art

Currently a chain saw includes a chain of cutters revolving around a guide bar. The cutter chain is rotated by a hydraulic motor. The hydraulic motor is rotated with a flow of hydraulic fluid from a hydraulic pump. The hydraulic pump is rotated with a electric motor, gas engine or diesel engine. The guide bar is fed against a piece of wood by an actuation device, such as a hydraulic cylinder. The required speed and feed of the chain saw requires that the engine/motor have a set horsepower. If an engine with less horsepower is used, the chain saw speed decreases or the feed is too great for the chain saw to cut the piece of wood. However, even if the speed of the chain saw is increased, the chain saw may stall if the chain saw is fed into the piece of wood with too much force.

U.S. Pat. No. 3,593,804 to Snider discloses a power cultivator. The Snider patent includes a portable power operated cultivating and digging machine preferably incorporating a gasoline engine as the prime mover. The engine drives a pulley and belt assembly, which in turn drives a sprocket. However, the drive ratio decreases the speed of the endless chain saw. U.S. Pat. No. 5,103,881 to Johnson discloses a log cutting apparatus. The Johnson patent includes a log cutting apparatus with a drive motor, a driving sprocket at a proximal end of a drive bar and a pulley sprocket at a distal end. The drive sprocket is a greater diameter than a pulley sprocket, thus providing an increased chain speed with respect to the speed of the drive motor. However, the Johnson patent provides no explanation as to the consequences of increasing chain saw speed relative to the feed rate of the chain saw.

Accordingly, there is a clearly felt need in the art for a method of increasing chain saw speed while regulating feed, which increases the speed of a chain saw for utilizing a lower horsepower motor by controlling the feed rate at which the saw bar is fed into a piece of wood.

SUMMARY OF THE INVENTION

The present invention provides a method of increasing chain saw speed while regulating feed, which increases the speed of a chain saw with a lower horsepower engine. The method of increasing chain saw speed while regulating feed (method of increasing chain saw speed) includes a speed increaser and a hydraulic flow bleeding device. The speed increaser preferably includes a drive sprocket, a driven sprocket, a motor plate, a bearing plate, a drive shaft and a drive belt. However, the belt drive may be replaced with gears or a chain drive. The motor plate is axially adjustable relative to the bearing plate. The motor is attached to the motor plate. A shaft bearing is attached to the bearing plate and the drive shaft is retained in the shaft bearing. The drive sprocket is attached to a shaft of a hydraulic motor. The driven sprocket is retained on the drive shaft. The driven sprocket is driven by the drive belt through the drive sprocket.

A mounting plate is secured to the bearing and motor plates. A chain saw assembly is secured to the mounting plate. The drive shaft is inserted into the chain saw assembly where the motor shaft would normally be inserted. An input of the hydraulic motor is connected to an output of a hydraulic pump. An output of the hydraulic motor is connected to an input of a hydraulic cylinder and the hydraulic flow bleeding device. The hydraulic flow bleeding device is preferably a needle valve, but other devices may also be used. The hydraulic flow bleeding device is set to meter a set amount of hydraulic fluid into the input of the hydraulic cylinder. The speed of the chain saw may decrease as thereof cuts through a piece of wood. As the speed of the chain saw decreases, the feed rate of the hydraulic cylinder will also decrease, because less fluid goes into the hydraulic cylinder.

Accordingly, it is an object of the present invention to provide a method of increasing chain saw speed, which increases the speed of a chain saw, while controlling the feed rate of the saw bar.

Finally, it is another object of the present invention to provide a method of increasing chain saw speed, which allows a lower horsepower source to be used to drive the fluid pump.

These and additional objects, advantages, features and benefits of the present invention will become apparent from the following specification.

DETAILED DESCRIPTION OF THE PREFERRED EMBODIMENTS

Figure 1:
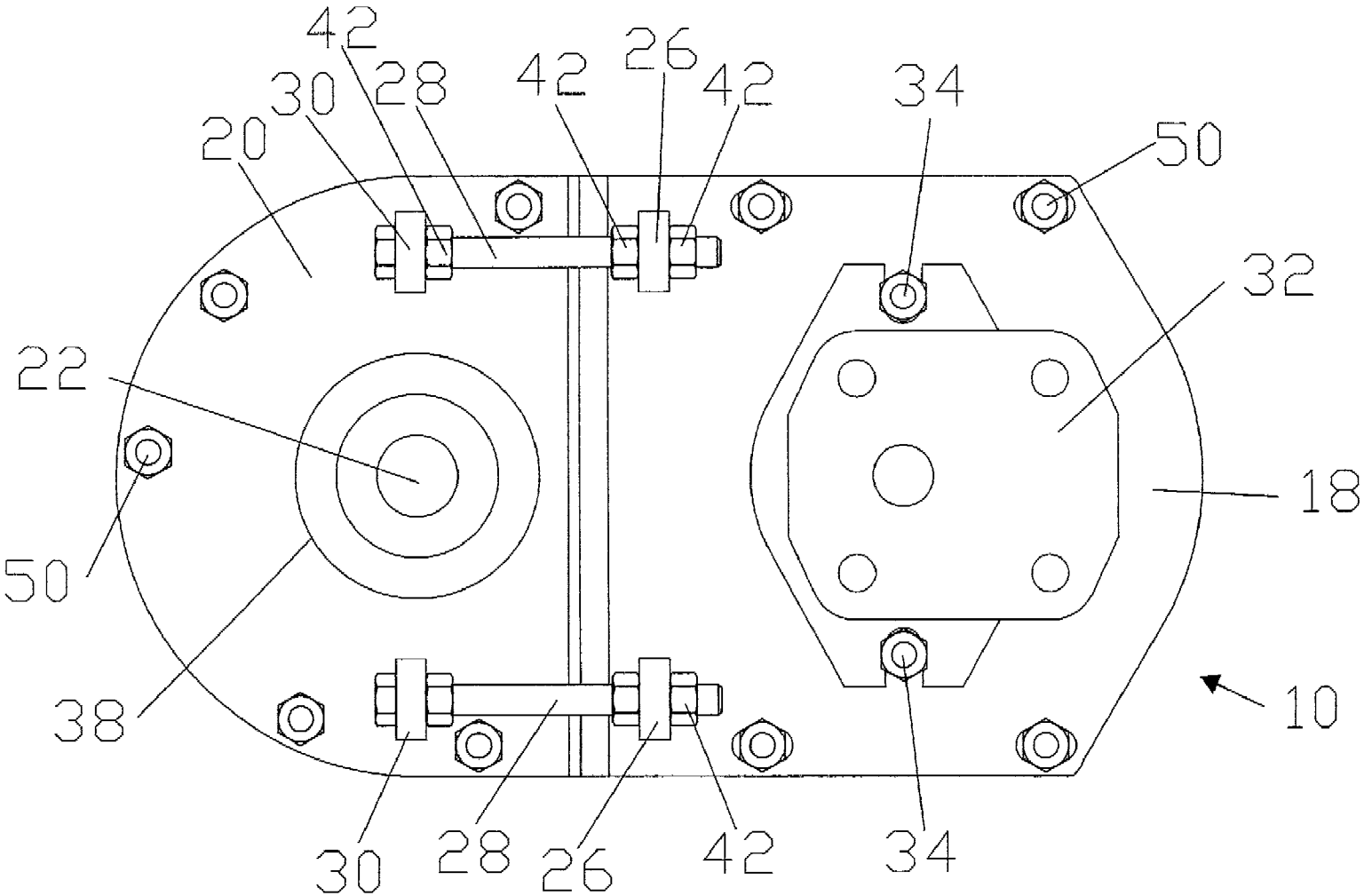
FIG. 1 is a top view of a speed increaser in accordance with the present invention.
Figure 2:
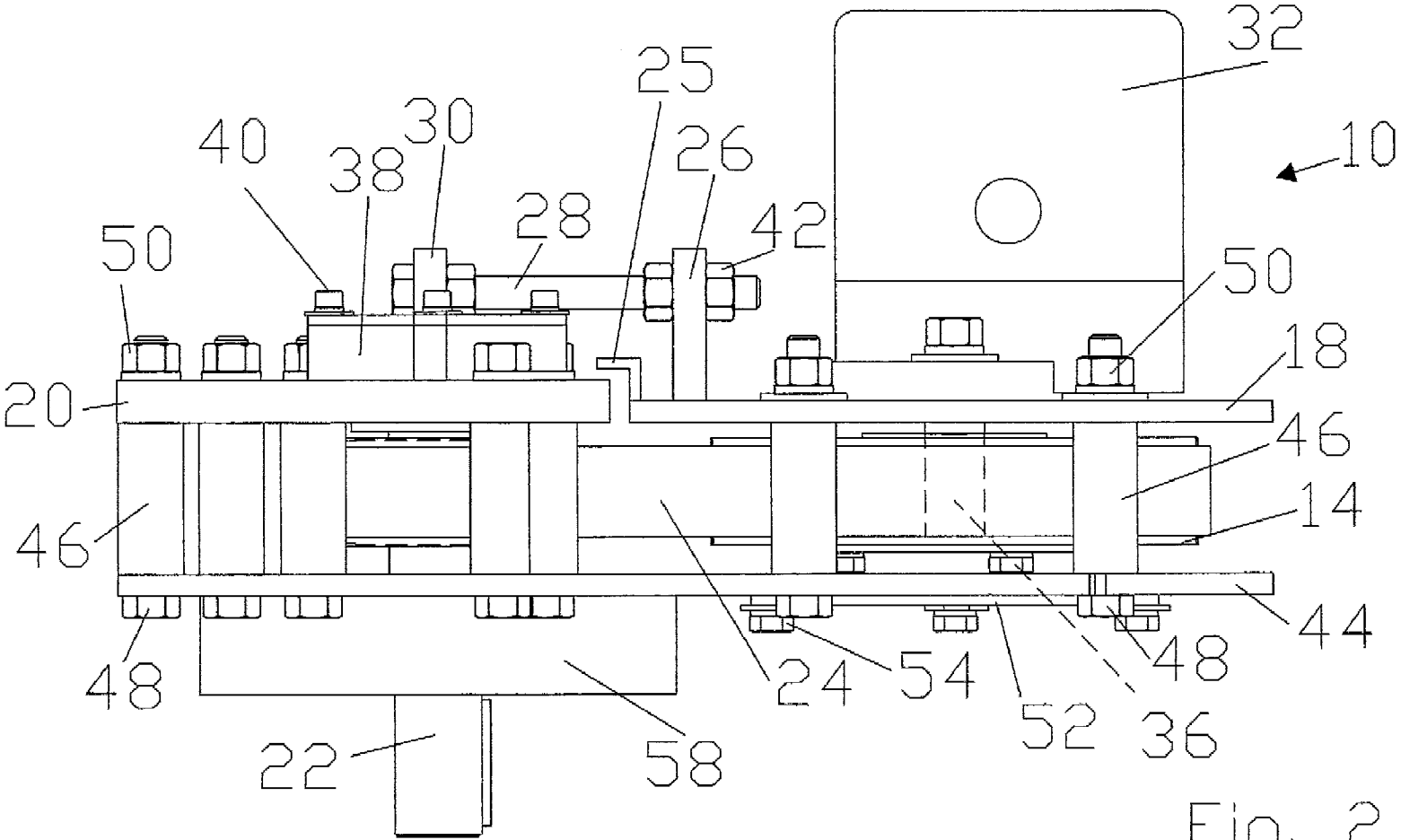
FIG. 2 is a front view of a speed increaser in accordance with the present invention.
Figure 3:
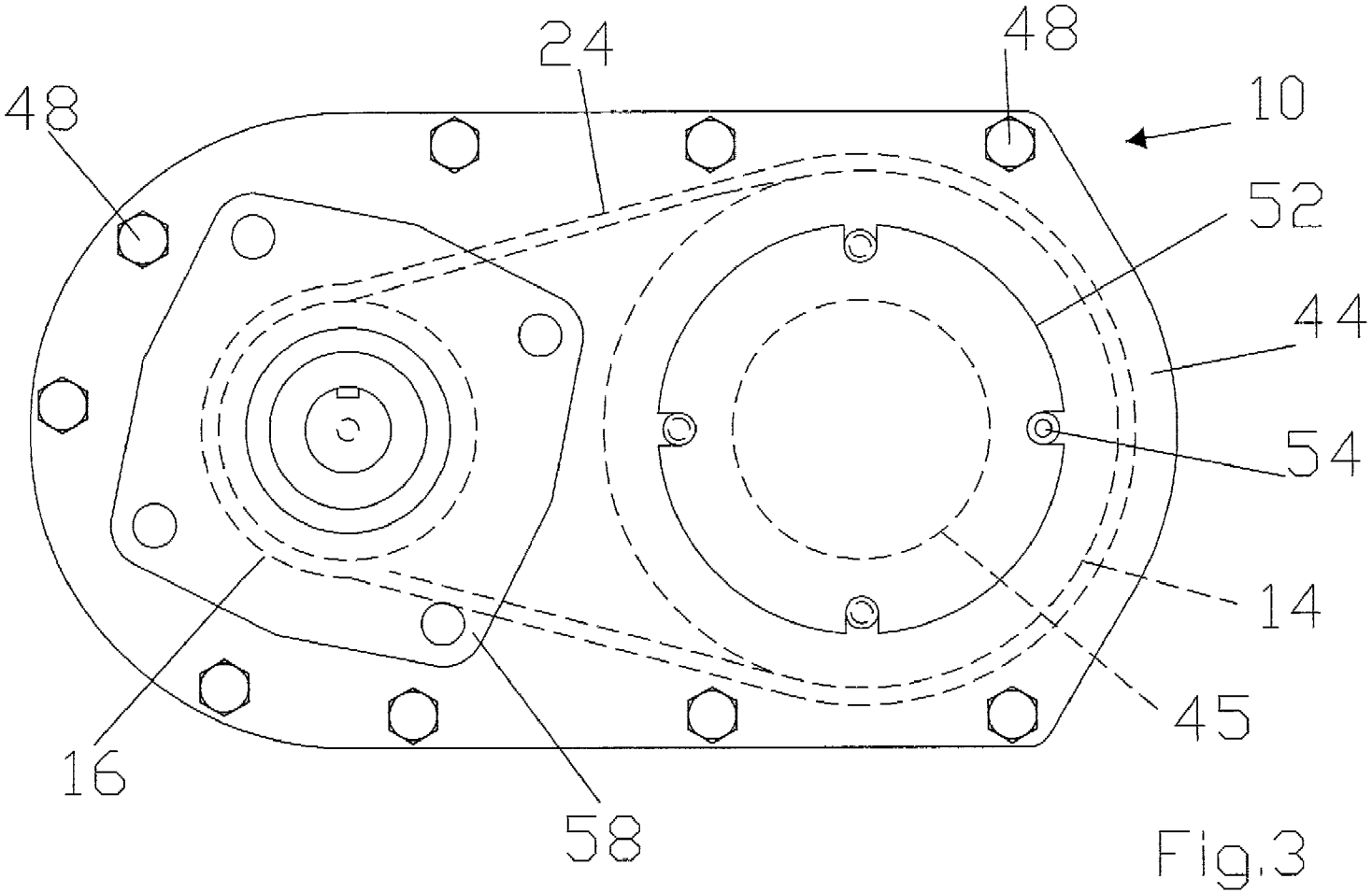
FIG. 3 is a bottom view of a speed increaser in accordance with the present invention.
Figure 8:
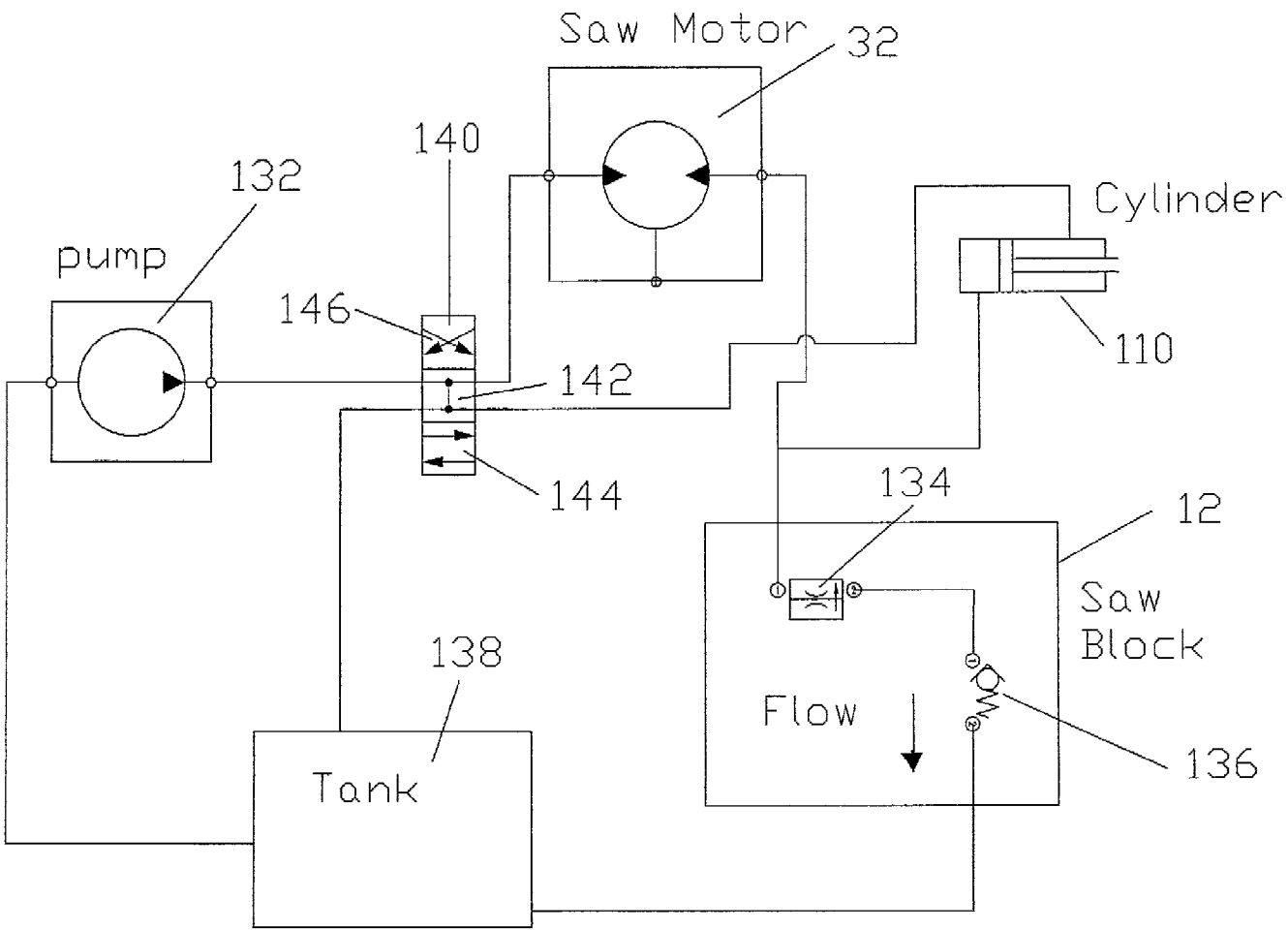
FIG. 8 is a schematic diagram of a method for increasing chain saw speed in accordance with the present invention.

With reference now to the drawings, and particularly to FIG. 8, there is shown a schematic diagram of a method of increasing chain saw speed. With reference to FIGS. 1-3, the method of increasing chain saw speed includes a speed increaser 10 and a saw block 12. The speed increaser 10 preferably includes a drive sprocket 14, a driven sprocket 16, a motor plate 18, a bearing plate 20, a drive shaft 22 and a drive belt 24. However, the belt drive speed increaser 10 may be replaced with a gear drive speed increaser or a chain drive speed increaser.

The motor plate 18 includes a pair of motor projections 26 for receiving a pair of adjustment fasteners 28. The bearing plate 20 includes a pair of bearing projections 30 for receiving the pair of adjustment fasteners 28. A gap cover 25 preferably covers a gap between the motor plate 18 and the bearing plate 20. The gap cover 25 may be secured to the motor plate 18 or the bearing plate 20. A hydraulic motor 32 is attached to the motor plate 18 with fasteners 34. A motor drive shaft 36 of the hydraulic motor 32 extends through the motor plate 18. A shaft bearing 38 is attached to the bearing plate with fasteners 40. The drive shaft 22 is retained in the shaft bearing 38. The pair of adjustment fasteners 28 are inserted through openings in the pair of bearing and motor projections. A plurality of nuts 42 are threaded on to the adjustment fasteners 28. The pair of adjustment fasteners 28 and the plurality of nuts 42 allow the distance between the motor drive shaft 36 and the drive shaft 22 to be changed. The drive sprocket 14 is secured on the motor drive shaft 36 and the driven sprocket 16 is secured on the drive shaft 22. The driven sprocket 16 is driven by the drive belt 24 through the drive sprocket 14.

A mounting plate 44 is preferably spaced from the bearing plate 20 and the motor plate 18 with a plurality of spacers 46. A plurality of fasteners 48 and nuts 50 are used to secure the mounting plate 44, the motor plate 18, the bearing plate 20 and the plurality of spacers 46 to each other. An access hole 45 is formed through the mounting plate 44 to allow the drive sprocket 14 to be tightened. A cover plate 52 is secured to the mounting plate 44 with a plurality of fasteners 54 to cover the access hole 45.

Figure 4:
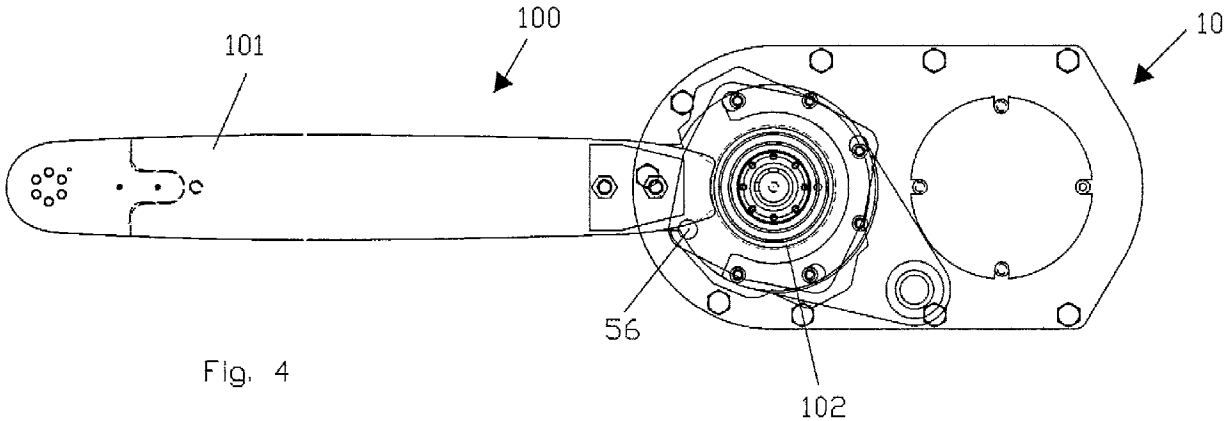
FIG. 4 is a bottom view of a chain saw assembly secured to a speed increaser in accordance with the present invention.
Figure 5:
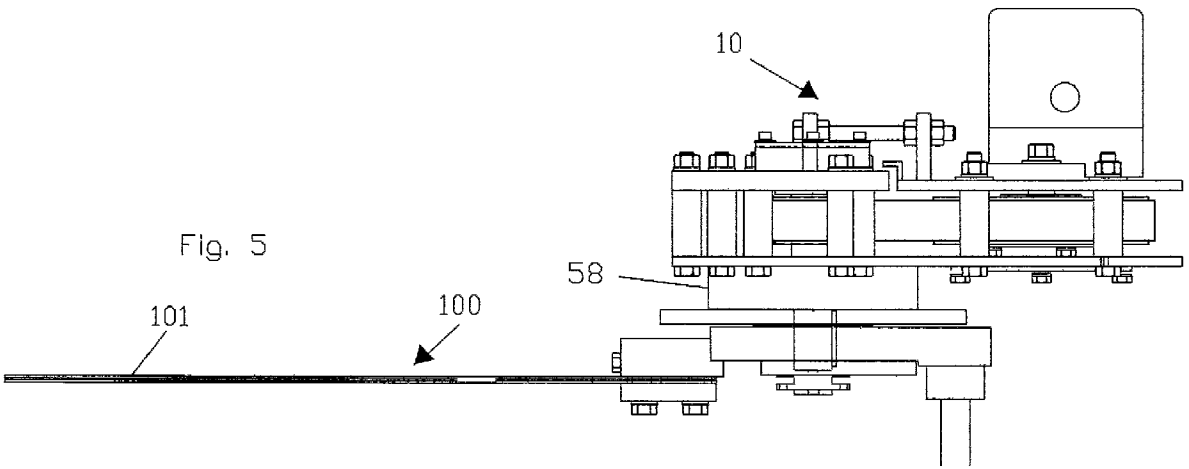
FIG. 5 is a front view of a chain saw assembly secured to a speed increaser in accordance with the present invention.

With reference to FIGS. 4-5, a chain saw assembly 100 is attached to the mounting plate 44 with a plurality of fasteners 56. A spacer plate 58 is used to provide clearance between a back side of the chain saw assembly 100 and the plurality of fasteners 48. The drive shaft 22 is inserted into a drive sprocket of the chain saw assembly 100. Normally, the motor drive shaft 36 is inserted into the drive sprocket 102 of the chain saw assembly 100.

Figure 7:
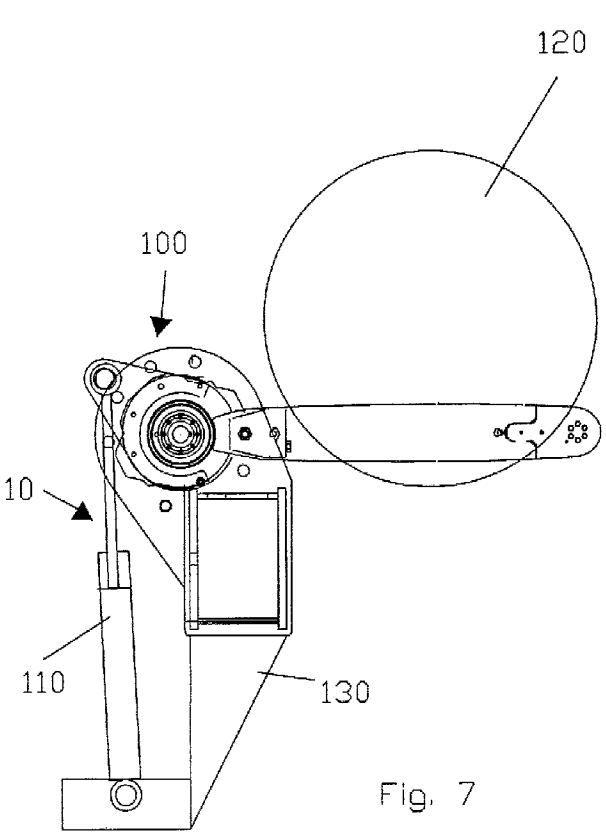
FIG. 7 is a bottom view of a chain saw assembly with a hydraulic cylinder in a substantially extended position in accordance with the present invention.
Figure 6:
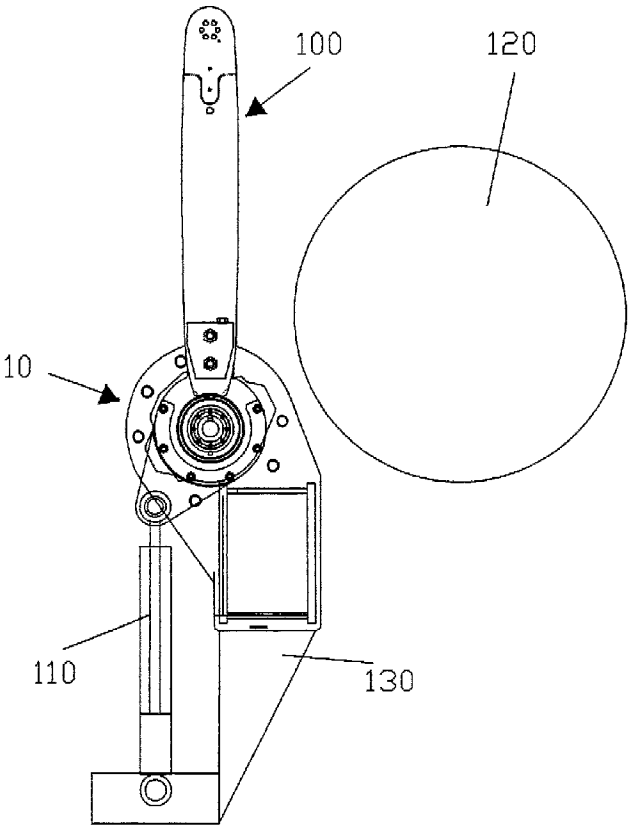
FIG. 6 is a bottom view of a chain saw assembly with a hydraulic cylinder in a retracted position in accordance with the present invention.

FIG. 6 is a bottom view of the chain saw assembly 100, the speed increaser 10 and a hydraulic cylinder 110 in a retracted position, adjacent a piece of wood 120. The speed increaser 10 is mounted to a support frame 130. One end of the hydraulic cylinder 110 is pivotally retained on the support frame 130 and the other end is pivotally mounted to chain saw assembly 100. FIG. 7 is a bottom view of the chain saw assembly 100 with the hydraulic cylinder 110 in a substantially extended position.

With reference to FIG. 8, an input of the hydraulic motor 32 is connected to an output of a hydraulic pump 132. An output of the hydraulic motor 32 is connected to an input of the hydraulic cylinder 110 and an input of a hydraulic flow bleeding device 134. The saw block 12 includes the hydraulic flow bleeding device 134 and a check valve 136. An output of the hydraulic flow bleeding device 134 is connected to an input of the check valve 136. The output of the check valve 136 is connected to a reservoir tank 138. The hydraulic flow bleeding device 134 is preferably a needle valve, but other devices may also be used. The hydraulic flow bleeding device 134 is set to meter hydraulic fluid into the input of the hydraulic cylinder 110. The remainder of the hydraulic fluid that does not go into the hydraulic cylinder 110 goes into the reservoir tank 138 through the hydraulic flow bleeding device 134 and the check valve 136.

A control valve 140 includes three positions. In an idle position (current position) 142, the hydraulic pump 132 pumps hydraulic fluid into the reservoir tank 138. In a normal operating position (lower position) 144, the hydraulic pump 132 pumps hydraulic fluid into the hydraulic cylinder 110. In a reverse position (upper position) 146, hydraulic fluid is pumped into the output of the hydraulic cylinder 110 to put the hydraulic cylinder 110 into a retracted position as shown in FIG. 6.

In use, the speed of a cutting chain 101 of the chain saw assembly 100 may decrease as thereof cuts through a piece of wood 120. As the speed of the cutting chain 101 decreases, the feed rate of the hydraulic cylinder 110 will also decrease, because less fluid will go into the hydraulic cylinder 110, which will prevent the chain saw assembly 100 from stalling.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of increasing chain saw speed while regulating feed, comprising the steps of:

providing a speed increaser having an input and an output, said output of said speed increaser having a greater speed than said input;

driving said input of said speed increaser with a hydraulic motor;

driving a chain saw with said output of said speed increaser;

connecting an output of a hydraulic pump to an input of said hydraulic motor; and connecting an output of said hydraulic motor to an input of a hydraulic cylinder and to a hydraulic flow bleeding device, said hydraulic cylinder controlling the feed rate of said chain saw.

2. The method of increasing chain saw speed while regulating feed of claim 1, further comprising the step of:

inserting a control valve between said output of said hydraulic pump and said input of said hydraulic motor.

3. The method of increasing chain saw speed while regulating feed of claim 2, further comprising the step of:

connecting an output of said hydraulic cylinder to said control valve.

4. The method of increasing chain saw speed while regulating feed of claim 1, further comprising the step of:

connecting said hydraulic flow bleeding device to an input of a check valve.

5. The method of increasing chain saw speed while regulating feed of claim 4, further comprising the step of:

connecting an output of said check valve to a reservoir tank.

6. The method of increasing chain saw speed while regulating feed of claim 1, further comprising the step of:

providing said speed increaser with a drive sprocket, a driven sprocket, a drive shaft and a mounting plate, driving said drive sprocket with said hydraulic motor, driving said driven sprocket with a drive belt, a drive shaft extending from said driven sprocket.

7. The method of increasing chain saw speed while regulating feed of claim 6, further comprising the step of:

inserting said drive shaft into a chain saw, attaching said chain saw to said mounting plate.

8. A method of increasing chain saw speed while regulating feed, comprising the steps of:

providing a speed increaser having an input and an output, said output of said speed increaser having a greater speed than said input;

driving said input of said speed increaser with a hydraulic motor;

driving a chain saw with said output of said speed increaser;

connecting an output of a hydraulic pump to an input of said hydraulic motor; and connecting an output of said hydraulic motor to an input of a hydraulic cylinder and to a hydraulic flow bleeding device, said hydraulic cylinder controlling a feed rate of said chain saw, the feed rate of said hydraulic cylinder decreasing as the speed of said chain saw decreases.

9. The method of increasing chain saw speed while regulating feed of claim 8, further comprising the step of:

inserting a control valve between said output of said hydraulic pump and said input of said hydraulic motor.

10. The method of increasing chain saw speed while regulating feed of claim 9, further comprising the step of:

connecting an output of said hydraulic cylinder to said control valve.

11. The method of increasing chain saw speed while regulating feed of claim 8, further comprising the step of:

connecting said hydraulic flow bleeding device to an input of a check valve.

12. The method of increasing chain saw speed while regulating feed of claim 8, further comprising the step of:

connecting said check valve to a reservoir tank.

13. The method of increasing chain saw speed while regulating feed of claim 8, further comprising the step of:

providing said speed increaser with a drive sprocket, a driven sprocket, a drive shaft and a mounting plate, driving said drive sprocket with said hydraulic motor, driving said driven sprocket with a drive belt, a drive shaft extending from said driven sprocket.

14. The method of increasing chain saw speed while regulating feed of claim 13, further comprising the step of:

inserting said drive shaft into a chain saw, attaching said chain saw to said mounting plate.

15. A method of increasing chain saw speed while regulating feed, comprising the steps of:

providing a speed increaser having an input and an output, said output of said speed increaser having a greater speed than said input;

driving said input of said speed increaser with a hydraulic motor;

driving a chain saw with said output of said speed increaser;

connecting an output of a hydraulic pump to an input of said hydraulic motor; and connecting an output of said hydraulic motor to an input of a hydraulic cylinder and to a hydraulic flow bleeding device, said hydraulic cylinder controlling a feed rate of said chain saw; and controlling the flow of hydraulic fluid between said hydraulic pump and said hydraulic motor with a control valve.

16. The method of increasing chain saw speed while regulating feed of claim 15, further comprising the step of:

connecting an output of said hydraulic cylinder to said control valve.

17. The method of increasing chain saw speed while regulating feed of claim 15, further comprising the step of:

connecting said hydraulic flow bleeding device to an input of a check valve.

18. The method of increasing chain saw speed while regulating feed of claim 17, further comprising the step of:

connecting said check valve to a reservoir tank.

19. The method of increasing chain saw speed while regulating feed of claim 15, further comprising the step of:

providing said speed increaser with a drive sprocket, a driven sprocket, a drive shaft and a mounting plate, driving said drive sprocket with said hydraulic motor, driving said driven sprocket with a drive belt, a drive shaft extending from said driven sprocket.

20. The method of increasing chain saw speed while regulating feed of claim 19, further comprising the step of:

inserting said drive shaft into a chain saw, attaching said chain saw to said mounting plate.

* * * * *